US005669239A

United States Patent [19]

Tobita

[11] Patent Number: 5,669,239

[45] Date of Patent: Sep. 23, 1997

[54] PIERCED EARRING WITH IMPROVED NUT

[75] Inventor: Osamu Tobita, Tokyo, Japan

[73] Assignee: Setsuko Ishida, Tokyo, Japan; a part interest

[21] Appl. No.: 698,689

[22] Filed: Sep. 4, 1996

Related U.S. Application Data

[63] Continuation of Ser. No. 365,813, Dec. 29, 1994, abandoned.

[30] Foreign Application Priority Data

Jan. 28, 1994 [JP] Japan ..... 6-026134

[51] Int. Cl.[6] ..... A44C 7/00

[52] U.S. Cl. ..... 63/12; 24/705; 24/706.6; 24/635; 24/537; 411/918

[58] Field of Search ..... 63/12; 24/705, 24/635, 537, 706.6, 706.7, 707.2, 707.5; 411/918, 256, 266, 348, 516, 511

[56] References Cited

U.S. PATENT DOCUMENTS

| | | | |
|---|---|---|---|
| 1,112,011 | 9/1914 | Kirchner | 24/707.5 |
| 1,168,528 | 1/1916 | Mason | 24/706.6 |
| 1,237,049 | 8/1917 | Jensen | 24/706.6 |
| 4,382,317 | 5/1983 | McDonald | 63/12 |
| 4,397,067 | 8/1983 | Rapseik | 63/12 |

FOREIGN PATENT DOCUMENTS

| | | | |
|---|---|---|---|
| 460731 | 12/1913 | France | 24/707.5 |
| 2498900 | 8/1982 | France | 63/12 |
| 10630 | of 1901 | United Kingdom | 24/706.6 |
| 1487 | of 1910 | United Kingdom | 24/706.6 |
| 21196 | of 1910 | United Kingdom | 24/707.5 |
| 2249252 | 5/1992 | United Kingdom | 63/12 |

*Primary Examiner*—Flemming Saether
*Attorney, Agent, or Firm*—Wenderoth, Lind & Ponack

[57] ABSTRACT

A pierced earring includes a pin member provided midway thereof with an engaging groove, and a nut including a cylindrical fastener body having therein a split groove or slit extending in the direction of the length thereof, an engaging ridge formed on an inner peripheral surface thereof and a guide part tapering at one end of the fastener body. Intimate union between the engaging ridge of the cylindrical fastener body and the engaging groove of the pin member is attained by insertion of the pin member through the guide part into the cylindrical fastener body.

4 Claims, 4 Drawing Sheets

PIERCED EARRING WITH IMPROVED NUT

This application is a continuation of now abandoned application Ser. No. 08/365,813, filed Dec. 29, 1994, abandoned.

BACKGROUND OF THE INVENTION

1. Field of the Invention

This invention relates to a pierced earring, i.e. an earring for use with a pierced ear.

2. Description of the Prior Art

A pierced earring is used for ornamentation, as shown in FIG. 8, for example, by setting a suitable accessory member 22 to a leading end of a pin member 21, forming an engaging groove 23 in a rear end of the pin member 21, thus forming a pierced earring body 20, inserting the pin member 21 through a hole in an earlobe E, and bringing a stopping member called a nut 25 from behind the earlobe E into fast attachment in the engaging groove 23 formed in the pin member 21. Nut 25 includes an earlobe abutment member or piece 26, two circular spring engaging parts 27 formed at each of respective opposite ends of the earlobe abutment piece 26, and an insertion hole formed at approximately a central position of the earlobe abutment piece 26 and adapted to permit passage therethrough of the pin member 21. Owing to this construction of the nut 25, the pierced earring body 20 can be fastened on the earlobe E by inserting the nut 25 around the pin member 21 from the rear end thereof onward until the spring engaging parts 27 of the nut 25 are fixed in the engaging groove 23 of the pin member 21.

The conventional nut 25 is formed more often than not with a thin plate of relatively soft metal such as, for example, 18-karat gold. The spring engaging parts 27 formed on the nut 25 are produced by circularly curling tongue-like pieces provided at each of the opposite ends of the earlobe abutment piece 26. As a result, the spring engaging parts 27 more often than not are deformed and lose resilience or springiness over time due to repeated attachment and detachment of the nut 25 to and from the pin member 21. Such pierced earring therefore has the disadvantage that it is possible that the nut 25 will fall off and the pierced earring body 20 will be lost from the earlobe E. In the worst case, the spring engaging part 27 will be broken such that the nut 25 no longer can be attached to or detached from the pin member 21.

In another version of the pierced earring, though not shown herein, a screw thread is formed on the exterior of the rear end of the pin member 21 of the pierced earring body 20 and an internally spirally wound thread is formed in the insertion hole of the nut 25. Such pierced earring is used by inserting the pin member 21 of the pierced earring body 20 into the hole in the earlobe E and advancing the spirally threaded nut 25 from behind the earlobe E into helical engagement with the screw thread formed on the pin member 21.

Such conventional pierced earring has the problem that when the spirally threaded nut 25 is helically attached to the screw thread of the pin member 21, hair from the user's head may enter the spirally threaded hole in the nut 25 and render highly troublesome the threaded attachment and detachment of the two parts.

The prior art pierced earrings mentioned also are disadvantageous in that the nut 25 is complicated in shape, thereby resulting in substantial losses of the material of the nut 25 during the fabrication thereof. Particularly, when such a material is 14-karat gold or 18-karat gold which has a very high unit price is used for the formation of the nut 25, heavy loss of such material has a serious effect on the cost of the nut 25. Thus, the prior art pierced earrings are not only uneconomical but also result in waste of natural resources.

This invention has been developed with regard to the prior art problems described above. It is an object of this invention to provide a pierced earring which is of simple construction and nevertheless has infallible attachability and strength and further permits reduction of waste of material during fabrication to the fullest possible extent.

SUMMARY OF THE INVENTION

The above object is achieved according to the present invention by the provision of a pierced earring including a pin member provided midway thereof with an engaging groove, and a nut including a cylindrical fastener body having therein a split groove or slit extending in the direction of a length thereof, an engaging ridge formed on an inner peripheral surface thereof and a guide part tapering at one end of the cylindrical fastener body, whereby intimate union between the engaging ridge of the cylindrical fastener body and the engaging groove of the pin member is accomplished by insertion of the pin member through the guide part into the cylindrical fastener body.

The invention will be better understood and the objects and features thereof other than those set forth will become apparent from the detailed description thereof given hereinbelow with reference to the accompanying drawings.

DETAILED DESCRIPTION OF THE PREFERRED EMBODIMENTS

The present invention will now be described in detail with reference to the illustrated embodiments.

Figure 1:
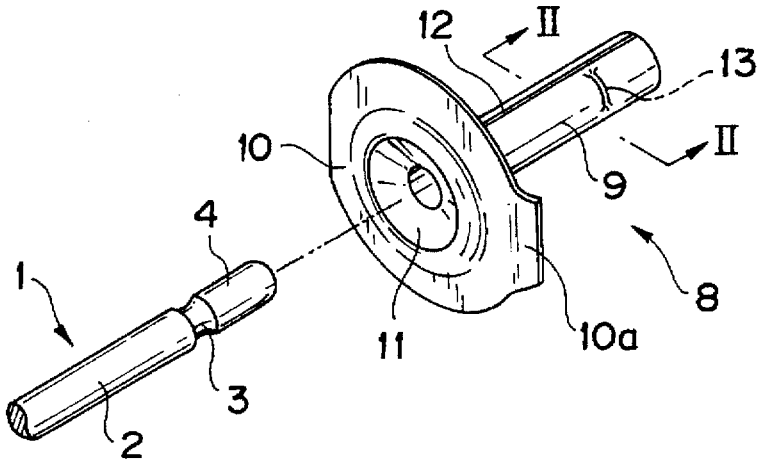
FIG. 1 is a perspective view illustrating one embodiment of this invention.
Figure 2:
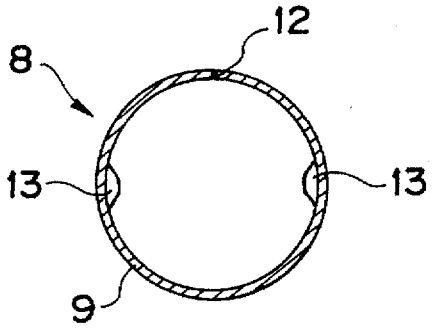
FIG. 2 is an enlarged cross section taken along line II—II in FIG. 1.
Figure 3:
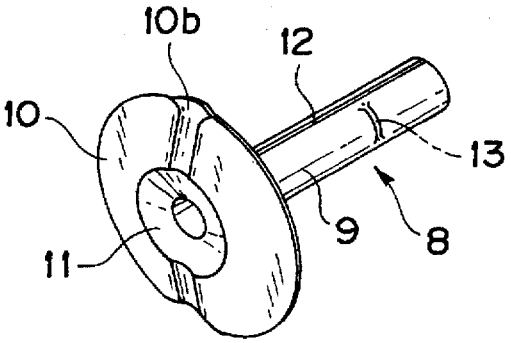
FIG. 3 is a perspective view illustrating another example of a flange part.
Figure 4:
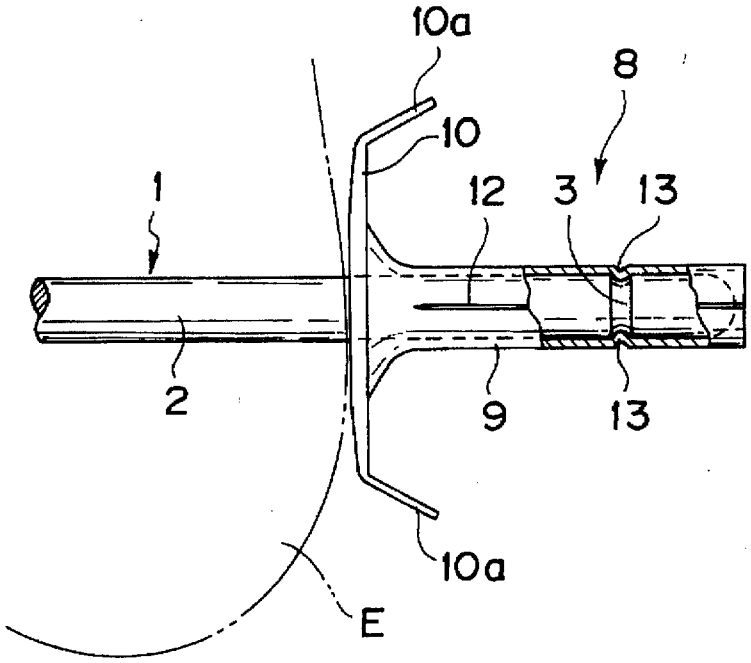
FIG. 4 is a partially cutaway explanatory view illustrating a state of fast union between a pin member and a fastener body.

FIGS. 1, 2 and 4 show one embodiment of the pierced earring according to the present invention, and FIG. 3 shows another example of a flange part of a nut.

As shown in FIG. 1, a pierced earring according to one embodiment of the present invention comprises a pin member 1 having an engaging groove 3 formed therein at a position near a leading end part thereof, and a nut 8 which includes a one-piece cylindrical fastener body 9 and a guide part 11 integral with one end of the cylindrical fastener body 9 and tapering toward such one end. The cylindrical fastener body 9 of the nut 8 has formed therein only one split groove or slit 12 that extends in the direction of a length thereof and an engaging ridge 13 formed on the inner peripheral surface thereof. Slit 2 is defined by two confronting longitudinal edges of faster body 9, and fastener body 9 is circumferentially continuous and uninterrupted between such two edges. The guide part 11 may have a flange 10, provided on an end thereof opposite body 9, with finger contact or resting parts 10*a*.

In the construction described above, the fastener body 9 of the nut 8 can be obtained by cutting a suitable length from a slender metallic pipe (not shown) or by rolling a metallic sheet of a suitable size (not shown) into a cylinder. Thus, a limited amount of material can be utilized to the maximum. The split groove 12 can be formed after the fastener body 9 has been obtained by cutting a suitable length of the slender metallic pipe, or the split groove 12 can be formed by causing opposed edges of a metallic sheet to collide against each other while the metallic sheet is being rolled into a cylinder. In the present embodiment, the split groove 12 is formed only in the fastener body 9. When each of the guide part 11 and the flange 10 is provided in the radial direction thereof with another split groove 12, the nut acquires stable resiliency. When the guide part 11 and the flange 10 are obtained by flaring one end of the fastener body 9 by a pressing technique, for example, the split groove 12 easily can be formed in such flange 10. The fastener body 9 of the present embodiment has a circular cross section as shown in FIG. 1. Optionally, it may be formed in a triangular, tetragonal or other similar polygonal cross section.

The fastener body 9 is provided on the inner peripheral surface thereof with the engaging ridge 13. In the present embodiment, engaging ridges 13 are formed at two respective spaced and confronting positions, for example, by slightly depressing inwardly the lateral walls of the fastener body 9 and consequently swelling the inner peripheral surface thereof as shown in FIG. 1 and FIG. 2. These engaging ridges 13 may be formed either integrally with the inner peripheral surface of the fastener body 9 or separately therefrom. The type of means to be used for obtaining these engaging ridges 13 is selected to suit the convenience of the actual work to be involved. The number of engaging ridges 13 to be formed is irrelevant and may be singular or plural as occasion demands.

The flange 10 may be formed, for example, at the same time that the guide part 11 is formed. In such case, the flange 10may be formed in any shape so long as the fastener body 9 can be provided integrally with the guide part 11. For example, the flange 10 may be provided with reinforcing ribs 10*b* as illustrated in FIG. 3. A short cylindrical member, not shown herein, may be used in the place of the flange 10, with the fastener body 9 fixed to the lateral surface of the short cylindrical member and an insertion hole for the pin member 1 formed so as to establish communication between the lateral surface of the short cylindrical member and the fastener body 9. The fastener body 9 and the guide part 11 are fixed to each other as by soldering. Optionally, members 9 and 11 may be integrally formed in one piece as by a pressing technique to obtain the nut 8. Alternatively, when the nut is formed by a deep drawing technique, the fastener body 9 and the guide part 11 can be integrally formed automatically. Though the fastener body 9 is furnished with the split groove 12 and consequently endowed with resiliency along the axial direction, it may be treated to suitably increase the resiliency in conformity with the characteristic properties of the material of which the fastener body 9 is made.

Such pierced earring will contact a human body directly. For the purpose of precluding deterioration of the quality of the earring, e.g. by perspiration or cosmetics, the pin member 1 and the nut 8 are made of a noble metal material such as, for example, 18-karat gold. However, members 1 and 8 may be formed of noble metals as gold, silver and platinum, iron and non-ferrous metals, or plastic materials. The selection of a material for members 1 and 8 is made to suit particular conditions. The nut 8 itself may be made to function as an accessory article by fitting a desired accessory article or a precious stone to the fastener body 9, though not illustrated herein.

Figure 5:
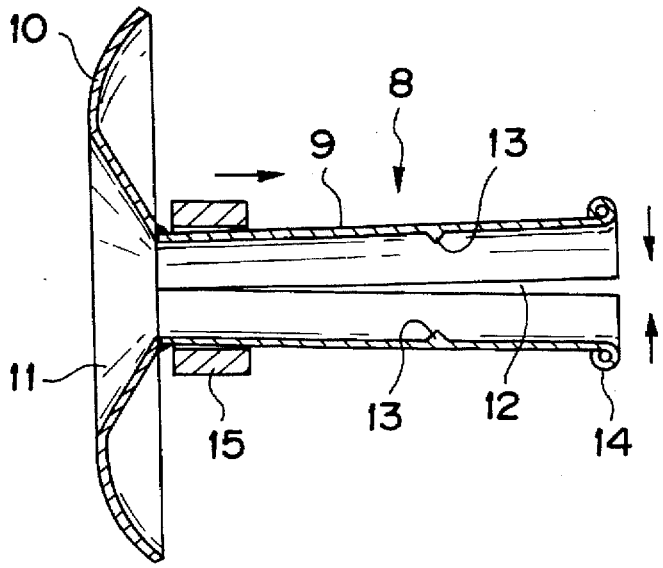
FIG. 5 is a cross section illustrating the construction of another embodiment of this invention.

FIG. 5 illustrates the construction of a second embodiment of the nut 8. In this embodiment, like parts corresponding to those of the first embodiment are denoted by like reference numerals. This embodiment, similarly to the first embodiment, constructs the nut 8 by providing the guide part 11 of a tapering shape at one end of the fastener body 9, forming the flange 10 on the guide part 11, forming the split groove 12 in the fastener body 9 in the direction of the length thereof, and providing the engaging ridge 13 on the inner peripheral surface of the fastener body 9. In the case of this embodiment, the fastener body 9 of the nut 8 has a smaller diameter at the end adjacent the guide part 11 and is formed so as to diverge slightly toward the opposite end thereof. A locking member 15 of an annular shape is disposed in such a manner on the outer peripheral part of the fastener body 9 as to be freely slidable thereon in the direction of the length of the fastener body 9. A slip arrest or stop 14 for the locking member 15 is formed at the terminal end of the fastener body 9. The locking member 15 is formed of a metallic or plastic material. The locking member 15 or the fastener body 9 may be properly adorned.

The operation of such embodiments now will be described below.

In the first embodiment, when an insertion portion 4 of the pin member 1 of the pierced earring is inserted through the hole in the earlobe E and then the nut 8 is fixed to the pin member 1 from behind the earlobe E as shown in FIG. 4, the engaging ridge 13 formed on the inner peripheral surface of the fastener body 9 comes into intimate union with the engaging groove 3 formed in the pin member 1. The pierced earring as an accessorial article thus is set into a state of use. At this time, the insertion of the pin member 1 can be effected smoothly because the fastener body 9 of the nut 8 is furnished with the guide part 11 with the flange 10. The finger rests 10*a* provided for the flange 10 serve to facilitate the handling of the nut 8.

In the case of the first embodiment, the split groove 12 is formed in the fastener body 9 of the nut 8 along the direction of the length thereof. When the insertion portion 4 of the pin member 1 is inserted into the guide part 11, the outer peripheral surface 2 of the pin member 1 collides against the engaging ridge 13 provided on the inner peripheral surface of the fastener body 9 and the fastener body 9 is expanded outwardly due to split groove 12, in spite of the resiliency of fastener body 9. When the pin member 1 in the ensuant state is further inserted until the engaging ridge 13 of the fastener body 9 reaches the position of the engaging groove 3 of the pin member 1, the resiliency of fastener body 9 causes it to resume its former state and the engaging ridge 13 is brought into intimate union with the engaging groove 3.

Figure 7:
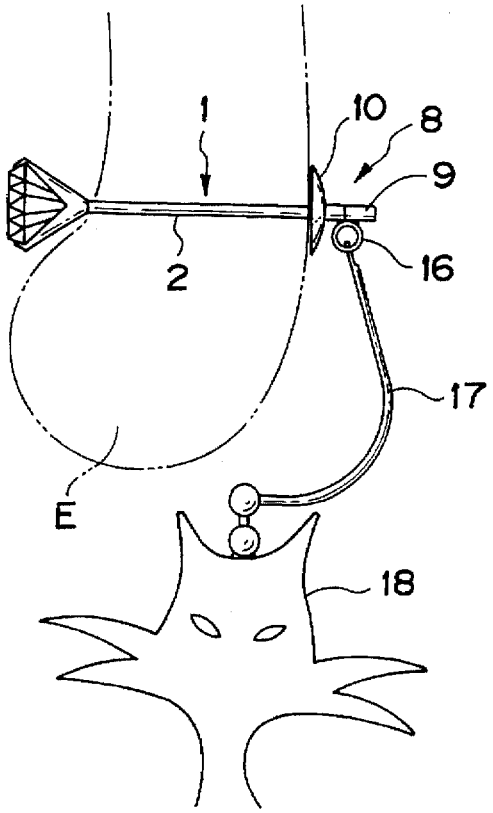
FIG. 7 is an explanatory view illustrating an accessory member provided on the fastener of this invention.
Figure 8:
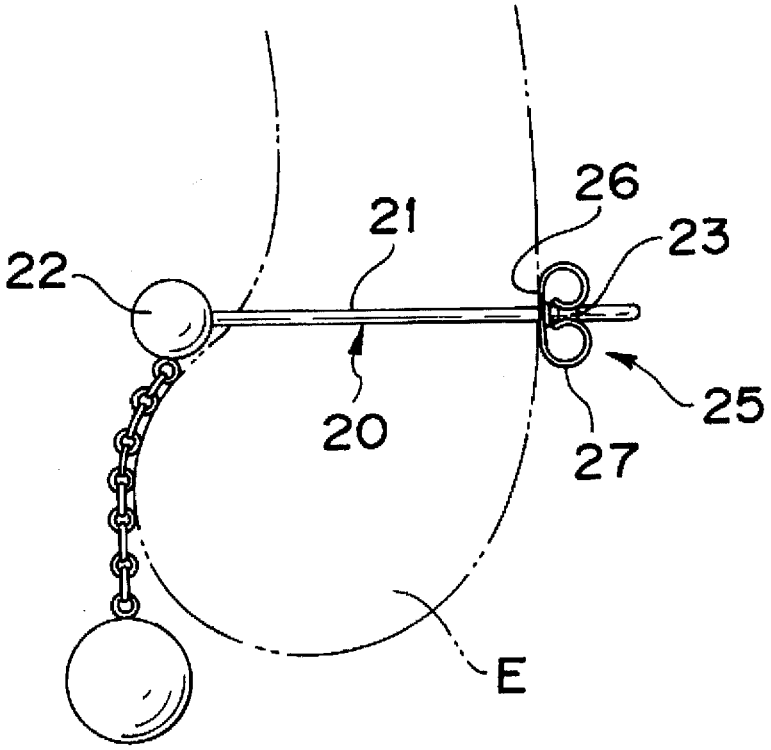
FIG. 8 PRIOR ART
FIG. 8 is an explanatory view illustrating a conventional fastener as attached to an earlobe.

As a result, the nut 8 of the pierced earring according to the first embodiment can be infallibly fixed to the pin member 1, and the fixation of the nut 8 to the pin member 1 can be stably retained for a long period of time because the possibility is slight that the fastener body 9 will be gradually deprived of its resiliency due to repeated attachment and detachment of the nut 8 to the pin member 1 is perfectly absent. Further, since the fastener body 9 which is an essential part of the nut 8 has a cylindrical shape and excellent strength, plural accessory items may be attached, e.g. by fixing a ring member 16 to the lateral surface of the fastener body 9, swivelly attaching one end of the pendant member 17 to the ring member 16 and attaching an ornamental member 18 to the other end of the pendant member 17, as shown in FIG. 7.

Figure 6:
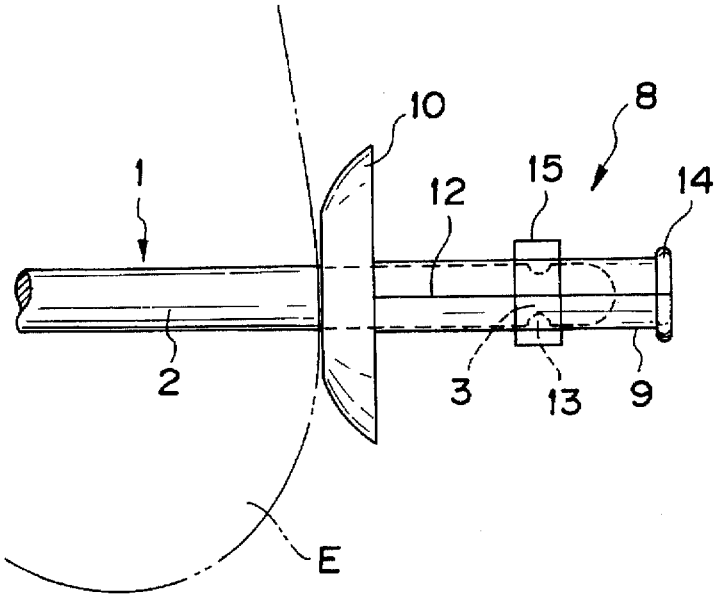
FIG. 6 is an explanatory view illustrating a state of fast union between the pin member and the fastener body in the structure of FIG. 5.

In accordance with the second embodiment, the engaging ridge 13 formed on the inner peripheral surface of the fastener body 9 is brought into intimate union with the engaging groove 3 formed in the pin member 1 and the pierced earring as an accessorial article is set in a state of use by inserting the insertion portion 4 of the pin member 1 through the hole in the earlobe E, positioning the guide part 11 and the fastener body 9 over the pin member 1 from behind the earlobe E, with the engaging ridge 13 of the fastener body 9 and the engaging groove 3 of the pin member being located in mutually coinciding aligned positions, and causing the locking member 15 to slide on the pin member 1 toward the rear end of the fastener body 9, as shown in FIG. 6.

The fastener body 9 of the nut 8 in the second embodiment is endowed with resiliency which is active in the axial direction. When the locking member 15 is caused to slide toward the rear end of fastener body 9, the inner peripheral surface of the locking member 15 radially contracts the rear end portion of the fastener body 9 against the resiliency thereof and causes the engaging ridge 13 of the fastener body 9 to come into intimate union with the engaging groove 3 in the pin member 1. The attachment and detachment of the pin member 1 is facilitated by providing the guide part 11 and the flange part 10 with a radial split groove (not shown). Since the resiliency of the fastener body 9 constantly causes the fastener body 9 to be urged against the inner peripheral surface of the locking member 15, there is a constant resilient state therebetween. Thus, there is no possibility that the nut 8 will separate by chance from the pin member 1.

It is clear from the above description that the pierced earring of this invention can manifest the following various effects. Since the engaging ridge for union with the engaging groove of the pin member is provided on the inner peripheral surface of the fastener body, and since the fastener body is provided with the split groove and consequently endowed with resiliency, the pierced earring which is provided by this invention will retain ideal attachability and stable strength for a long period of time, compared with the conventional pierced earring which deforms and gradually loses resiliency, possibly to the extent of inducing accidental separation thereof. Further, since the fastener body is provided with the guide part, the attachment to the pin member can be smoothly effected. Moreover, since the pierced earring of this invention has a simple construction due to the use of a cylindrical fastener body, the material employed for the formation of the fastener body can be utilized in a production process to the fullest possible extent and the cost of production of the pierced earring can be notably reduced. The simplicity of construction also contributes to facilitation of storage and transportation of the produced pierced earrings.

What is claimed is:

1. A pierced earring comprising:

a pin member having formed therein an engaging groove;

a nut made from resilient thin plate material and including a one-piece cylindrical fastener body having first and second opposite ends, said second end being open;

a guide part integral with said first end of said fastener body and tapering therefrom in a direction outwardly therefrom and away from said second end of said fastener body, thereby forming means to guide insertion of said pin member into said fastener body;

a radial flange extending outwardly from said guide part in an axial direction toward said second end;

a pair of engaging ridges integral with said fastener body and extending inwardly from an inner peripheral surface thereof at locations to fit in said engaging groove when said pin member is inserted into said fastener body;

said fastener body having formed therein only a single slit extending longitudinally thereof from said second end thereof throughout substantially the entire length thereof, and thereby defining means to enable said fastener body to deform outwardly, in cooperation with the resiliency of said plate material, during insertion of said pin member into said fastener body and to contract resiliently inwardly when said engaging ridges become aligned with said engaging groove, thus ensuring intimate engagement of said engaging ridges in said engaging groove; and said single slit being defined by confronting longitudinal edges of said fastener body, said fastener body being circumferentially continuous and uninterrupted from a first said edge to a second said edge.

2. A pierced earring as claimed in claim 1, further comprising finger contact projections extending outwardly from said flange.

3. A pierced earring as claimed in claim 1, wherein said flange has at least one radial reinforcing rib.

4. A pierced earring as claimed in claim 1, wherein said guide part and said flange are circumferential continuous and uninterrupted.

* * * * *